US012111127B1

(12) United States Patent
Withey

(10) Patent No.: US 12,111,127 B1
(45) Date of Patent: Oct. 8, 2024

(54) BARREL ATTACHMENT SYSTEM FOR RIFLE

(71) Applicant: Kimber IP, LLC, Troy, AL (US)

(72) Inventor: Michael Withey, Brundidge, AL (US)

(73) Assignee: Kimber IP, LLC, Troy, AL (US)

( * ) Notice: Subject to any disclaimer, the term of this patent is extended or adjusted under 35 U.S.C. 154(b) by 57 days.

(21) Appl. No.: 18/132,628

(22) Filed: Apr. 10, 2023

(51) Int. Cl.
*F41A 21/48* (2006.01)

(52) U.S. Cl.
CPC ..... *F41A 21/482* (2013.01); *F41A 21/484* (2013.01)

(58) Field of Classification Search
CPC ..... F41A 21/48; F41A 21/482; F41A 21/484; F41A 21/487
See application file for complete search history.

(56) References Cited

U.S. PATENT DOCUMENTS

| | | | | |
|---|---|---|---|---|
| 534,691 | A * | 2/1895 | Hepburn | F41A 21/482 42/75.02 |
| 6,487,805 | B1 * | 12/2002 | Reynolds | F41A 21/485 42/75.03 |
| 11,402,169 | B1 * | 8/2022 | Sohegian | F41A 21/485 |
| 2005/0188591 | A1 | 9/2005 | Stone | |
| 2019/0086175 | A1 * | 3/2019 | Karagias | F41A 21/482 |
| 2020/0333097 | A1 * | 10/2020 | Hendricks | F41A 21/487 |

* cited by examiner

*Primary Examiner* — Jonathan C Weber
(74) *Attorney, Agent, or Firm* — Kaplan Breyer Schwarz, LLP

(57) ABSTRACT

A system for securing a barrel to a receiver of a rifle includes a barrel extension and a locking wedge. The barrel extension receives threads on the barrel and has a protuberance. The locking wedge is secured in an aperture in the receiver by a fastener. The locking wedge has a side parallel to the aperture, and a cam side disposed at an angle. The locking wedge is movable in a direction perpendicular to the barrel axis. The cam side is disposed against the protuberance. Tightening the fastener causes the cam side of the locking wedge to urge the protuberance of the barrel extension along the barrel axis in a direction away from the muzzle end of the barrel into the receiver.

6 Claims, 10 Drawing Sheets

BARREL ATTACHMENT SYSTEM FOR RIFLE

BACKGROUND OF THE INVENTION

The present invention is directed to rifles. More particularly, the present invention is directed to a system for securing a barrel to a rifle.

Manual firearms, such as bolt action rifles, are designed to fire a round of ammunition, such as a cartridge, in response to each squeeze of the trigger of the firearm. Thereafter a bolt assembly in the receiver of the firearm is manually operated to eject the empty shell or cartridge casing and load the next shell or cartridge from the firearm magazine into the chamber of the firearm.

The barrel of such firearms may be easily disassembled for replacement and/or to enable a change of calibers of ammunition to be used in the firearm and/or to provide for replacement of damaged barrels and/or use of barrels of different lengths for different end use scenarios.

Typical receivers for common bolt action rifles provide a housing for the hammer, bolt, and firing mechanism of the rifle, and receive a barrel extension to mate the barrel with the receiver.

SUMMARY OF THE INVENTION

In a first exemplary embodiment, the present invention is directed to a system for securing a barrel to a receiver of a rifle. The barrel has a barrel axis, a muzzle end and a receiver end. The system includes a barrel extension and a locking wedge. The barrel extension has a barrel end and a receiver end, and internal threads at its barrel end for receiving external threads on the barrel. The barrel extension further has a protuberance extending from its lower side. The locking wedge is slidably secured in an aperture in the receiver by a threaded fastener. The locking wedge has a central aperture, a first side parallel to the central aperture, and a cam side opposite the first side and disposed at an angle relative to the first side. The locking wedge is movable along an axis of the threaded fastener in a direction perpendicular to the barrel axis by rotating the threaded fastener. The cam side disposed against the protuberance.

Tightening the threaded fastener into the receiver causes the cam side of the locking wedge to urge the protuberance of the barrel extension along the barrel axis in a direction away from the muzzle end of the barrel and into the receiver. Loosening the threaded fastener causes the cam side of the locking wedge to allow the barrel extension to move along the barrel axis in a direction toward the muzzle end of the barrel. Tightening the threaded fastener urges the barrel extension into the receiver, seating and aligning the barrel within the receiver.

The barrel extension may be tapered at the receiver end to mate with a corresponding tapered aperture in the receiver. A barrel extension locking nut may be provided having internal threads for receiving the external threads on the barrel. The locking nut is disposed adjacent the barrel end of the barrel extension. The receiver may fully cover the locking nut such that the locking nut is hidden within the receiver.

DETAILED DESCRIPTION

Figure 1:
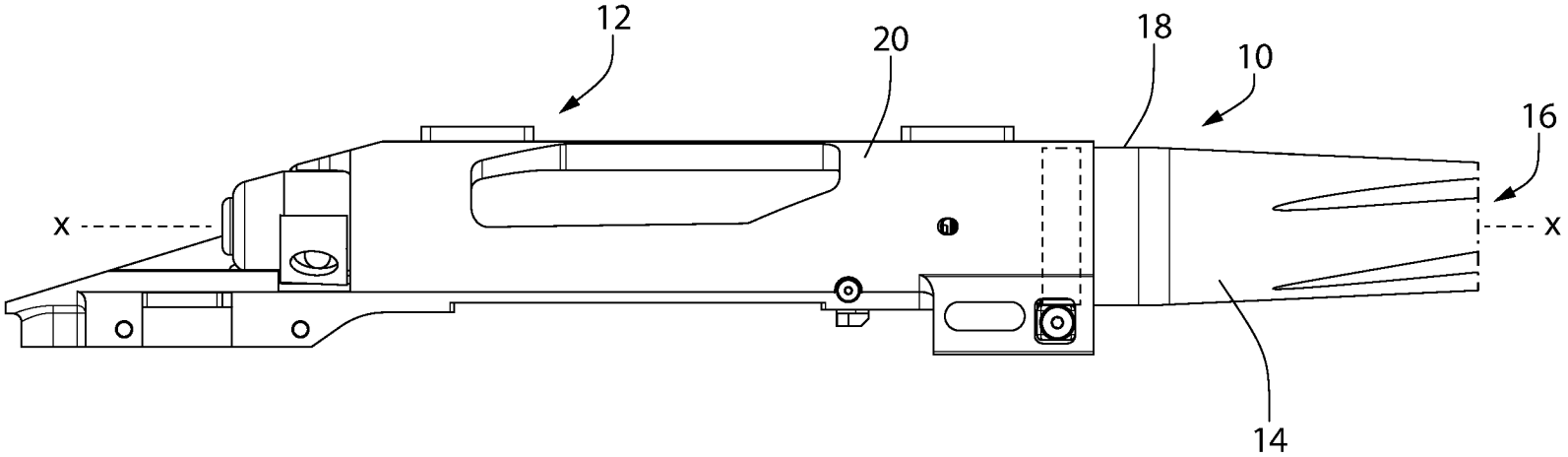
FIG. 1 is a side elevation view of a system for securing a barrel to a receiver in a rifle in accordance with an exemplary embodiment of the present invention.
Figure 2:
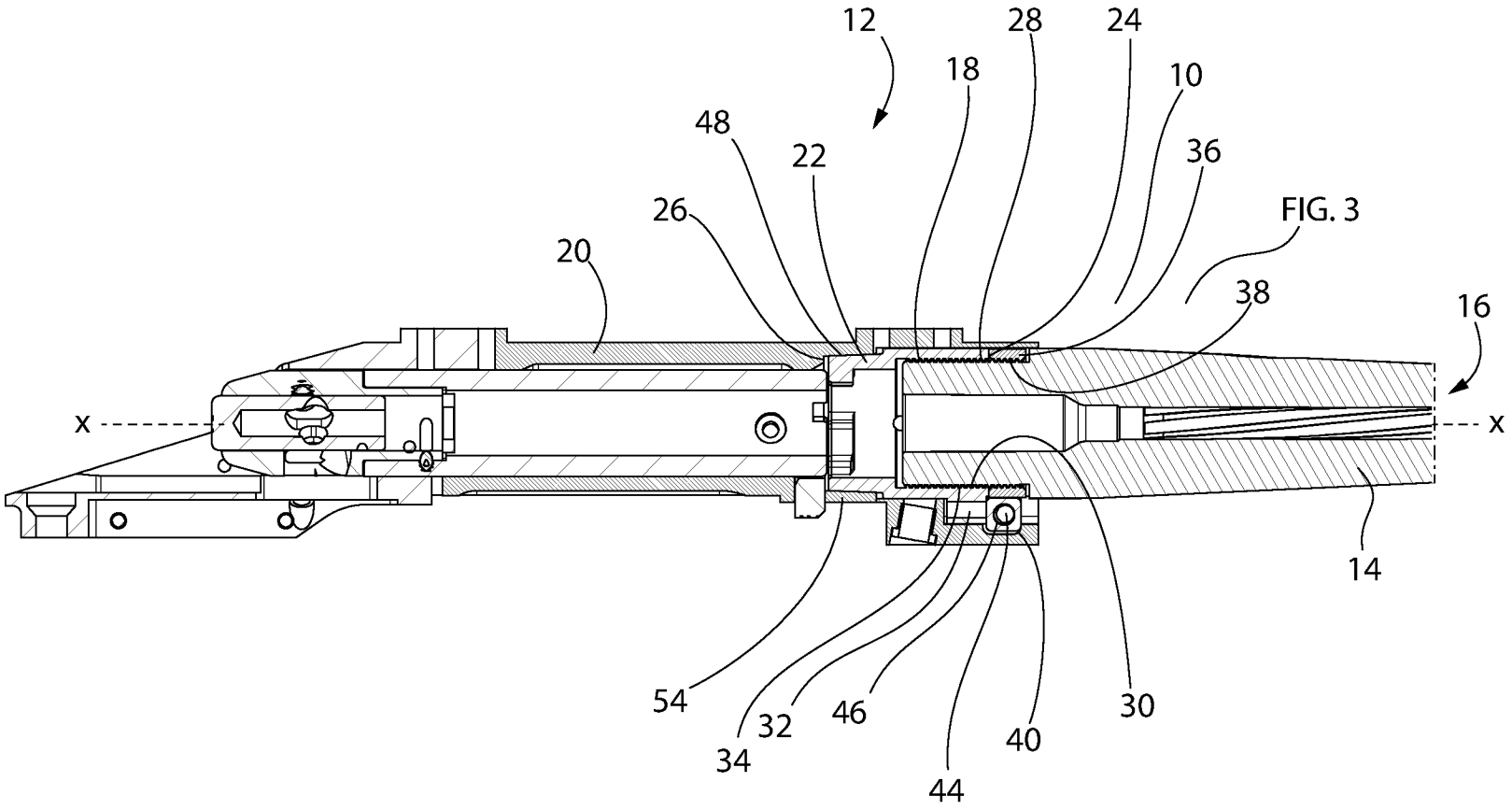
FIG. 2 is a cross-sectional view of the system for securing a barrel to a receiver in a rifle of FIG. 1.
Figure 3:
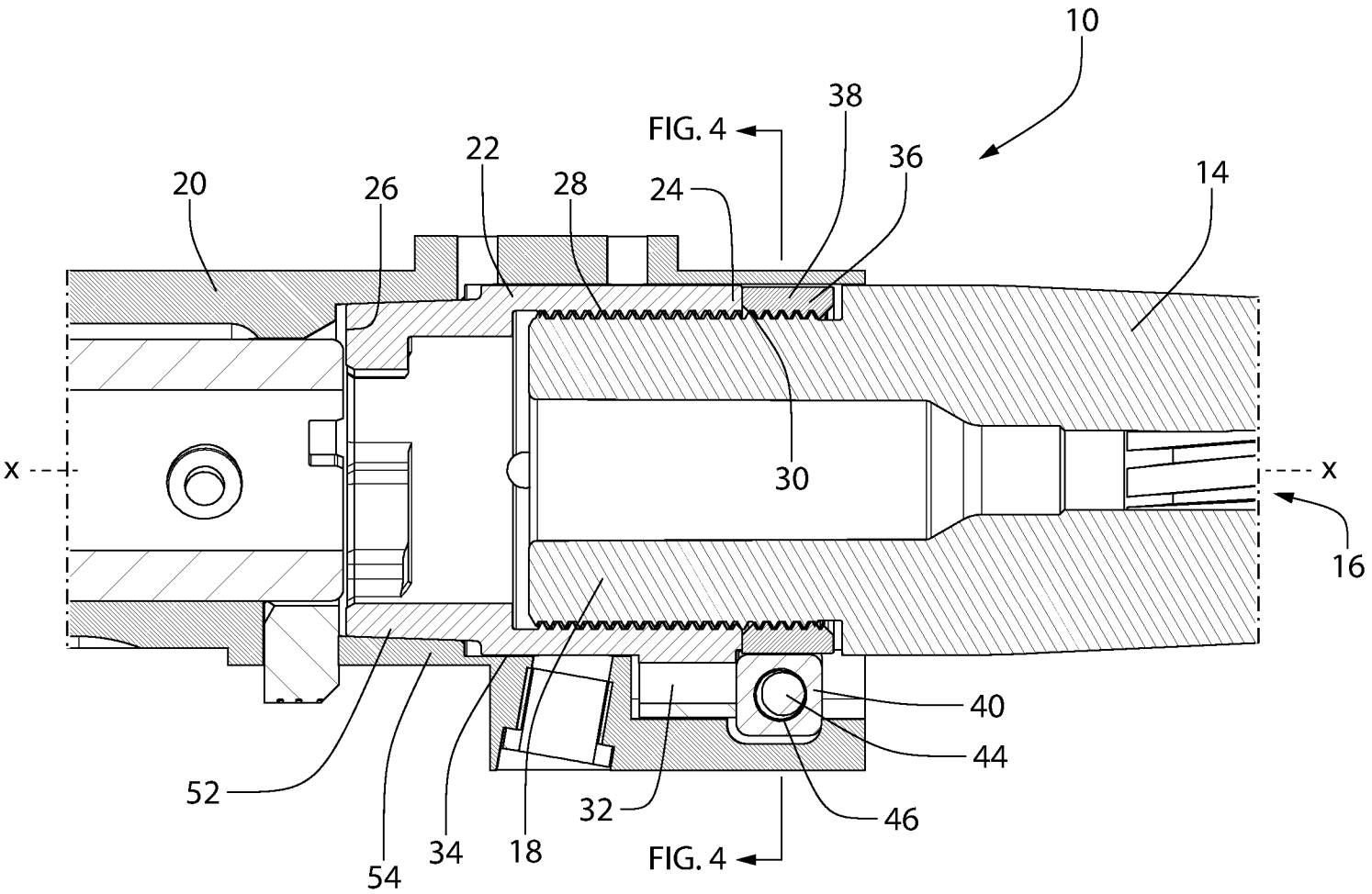
FIG. 3 is an enlarged cross-sectional view of the system for securing a barrel to a receiver in a rifle of FIG. 1, taken at callout FIG. 3 of FIG. 2.
Figure 4:
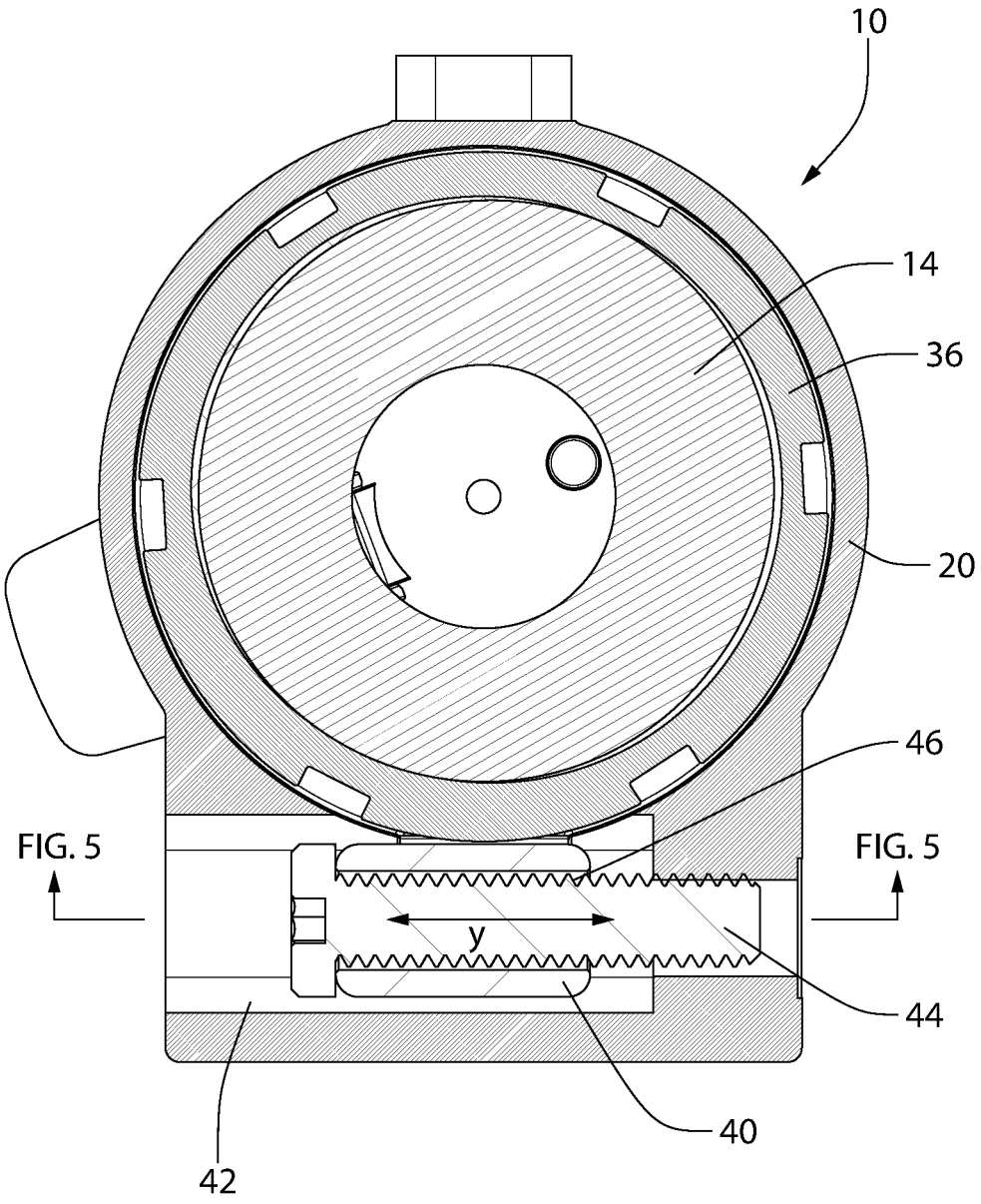
FIG. 4 is a cross-sectional view of the system for securing a barrel to a receiver of FIG. 1, taken at callouts FIG. 4-FIG. 4 of FIG. 3.
Figure 5:
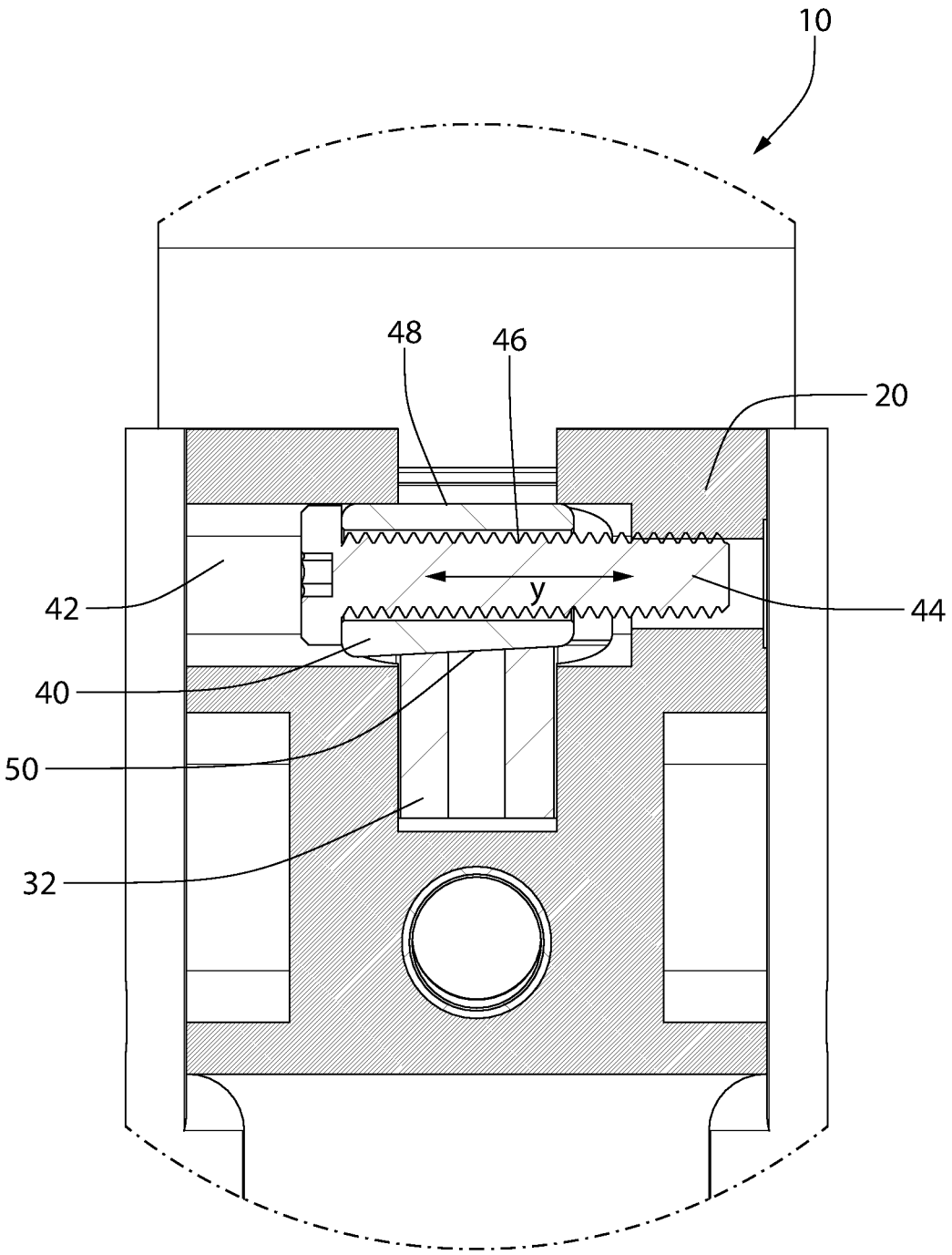
FIG. 5 is a cross-sectional view of the system for securing a barrel to a receiver of FIG. 1, taken at callouts FIG. 5-FIG. 5 of FIG. 4.
Figure 6:
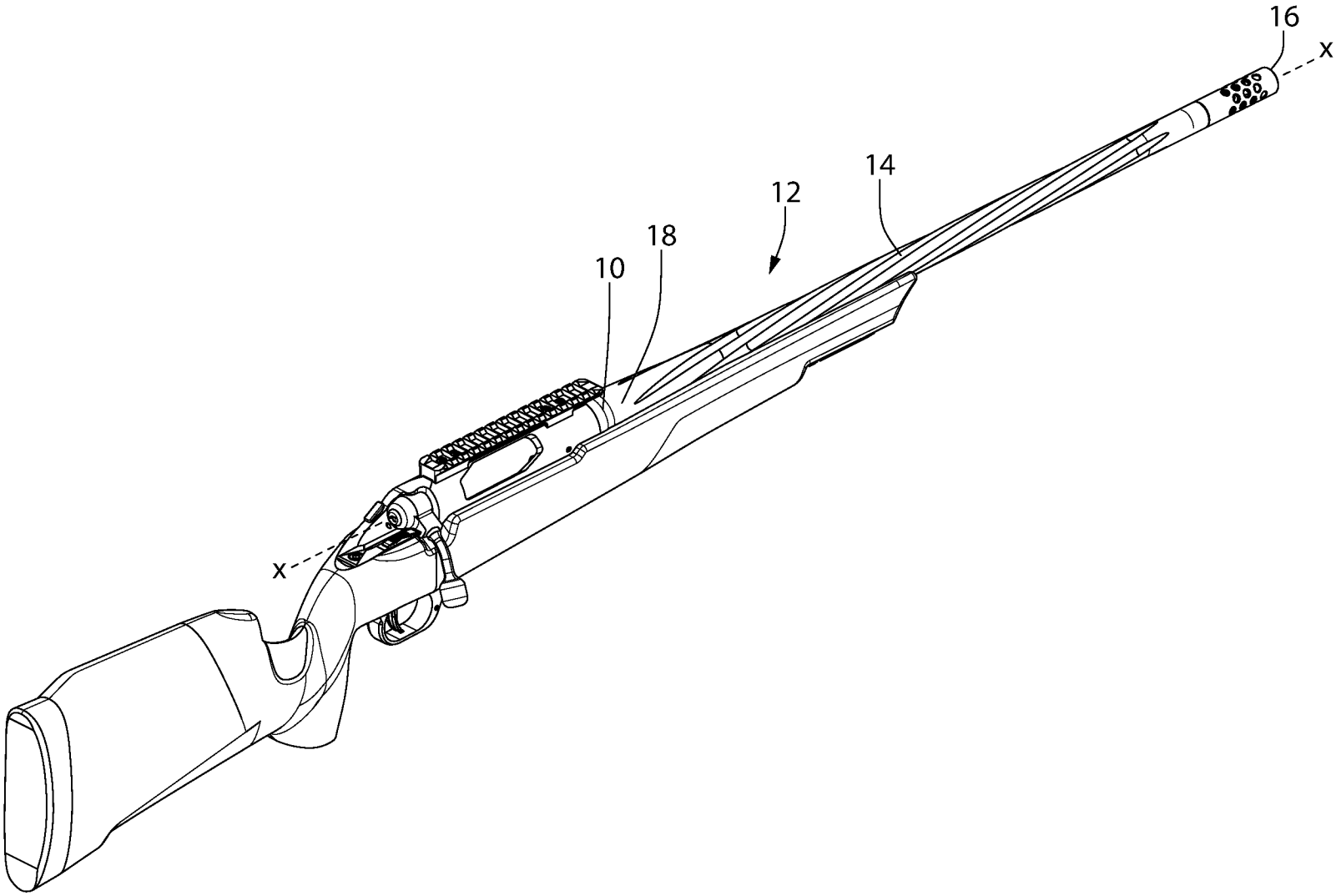
FIG. 6 is an example of a bolt action rifle having a system for securing a barrel to a receiver of FIG. 1.
Figure 7:
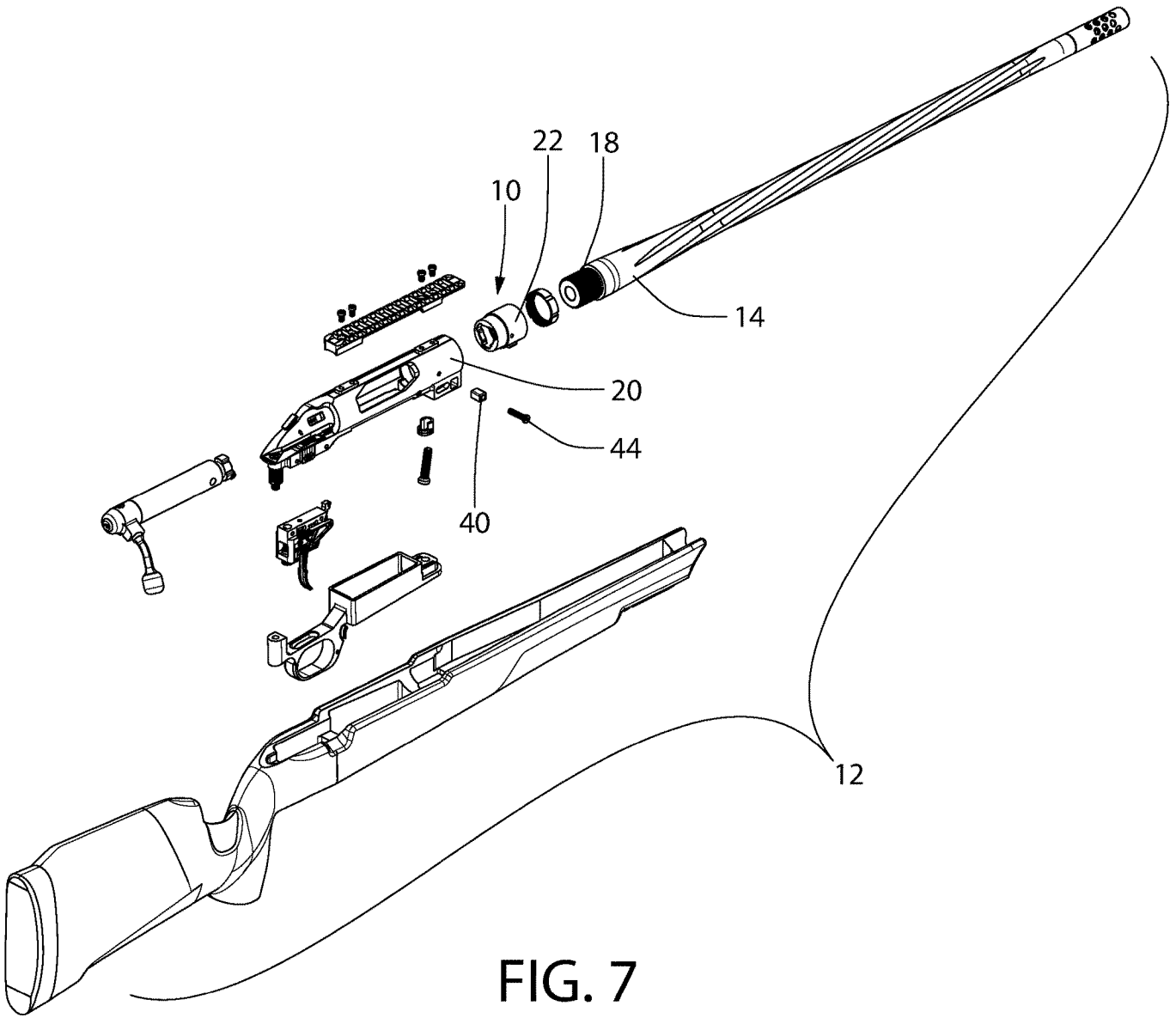
FIG. 7 is an exploded isometric view of the bolt action rifle having a system for securing a barrel to a receiver.

Referring now to the drawing figures wherein like reference numbers refer to like elements throughout the several views, there is shown in FIGS. 1-5 a system for securing a barrel to a receiver of a rifle 10 in accordance with an exemplary embodiment of the present invention. As shown in FIG. 6 and in the exploded view of FIG. 7, the system 10 is used on a rifle 12, for example a bolt action rifle. The rifle 12 generally includes a barrel 14 having a barrel axis X, with a muzzle end 16 and a receiver end 18 and a receiver 20 that houses the hammer, bolt, and firing mechanism of the rifle.

Figure 8A:
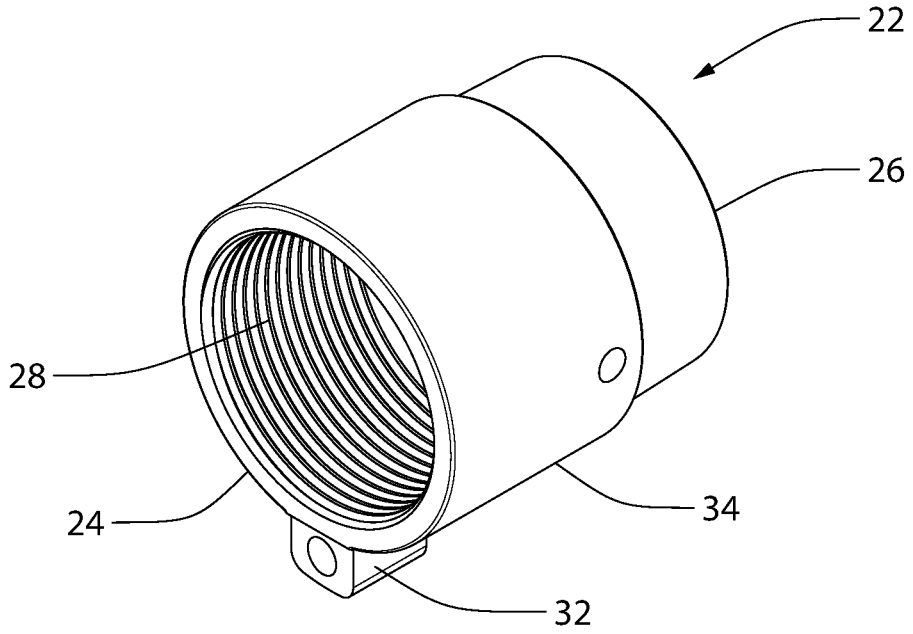
FIG. 8A is a front isometric view of a barrel extension for the system for securing a barrel to a receiver in a rifle of FIG. 1.
Figure 8B:
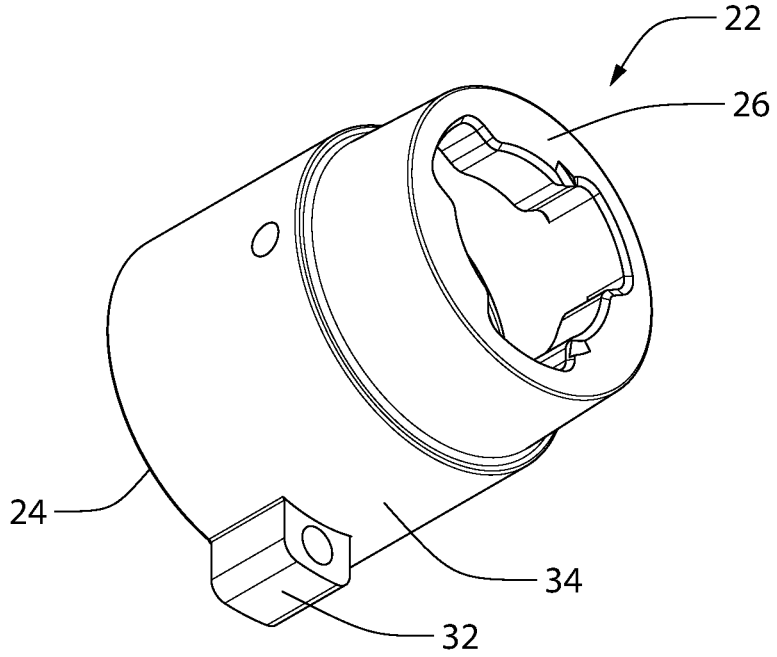
FIG. 8B is a rear isometric view of the barrel extension of FIG. 8A.

The system can best be seen in FIGS. 2-5 and further includes a barrel extension 22 having a barrel end 24 and a receiver end 26 for mating the barrel 14 to the receiver 20. See FIGS. 8A and 8B. The barrel extension 22 has internal threads 28 at its barrel end 24 for receiving external threads 30 on the receiver end 18 of the barrel 14. A protuberance 32 extends from a lower side 34 of the barrel extension 22.

Figure 10:
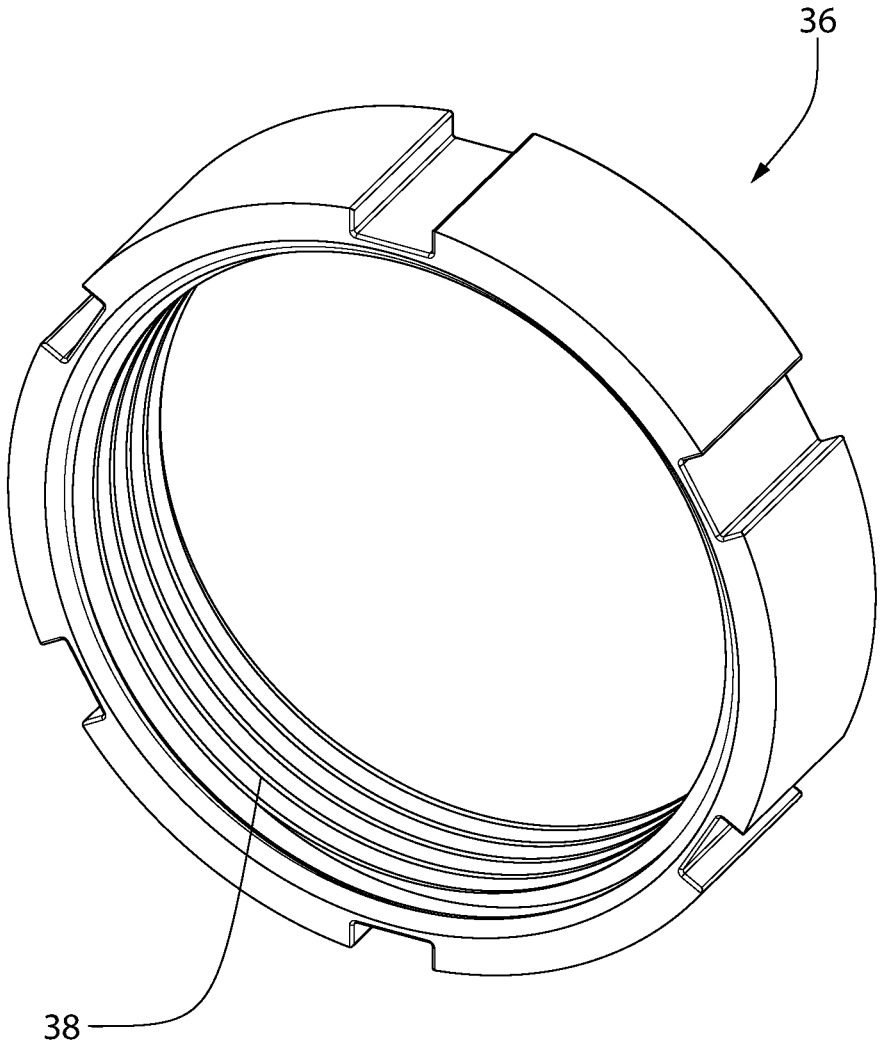
FIG. 10 is front isometric view of a barrel extension locking nut for the system for securing a barrel to a receiver in a rifle of FIG. 1.

A barrel extension locking nut 36 is provided having internal threads 38 for receiving the external threads 30 on the receiver end 18 of the barrel 14. See FIG. 10. The locking nut 36 is disposed adjacent to the barrel end 24 of the barrel extension 22 and provides for setting of head space. Alternatively, a shouldered attachment or a pinned attachment, as known, may be used.

Figure 9A:
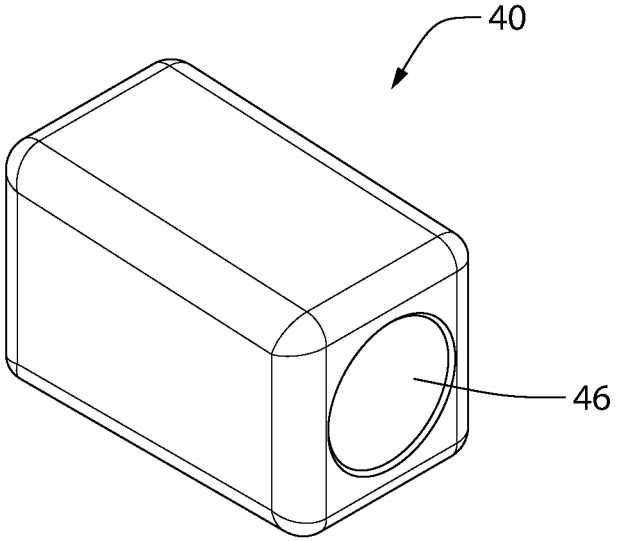
FIG. 9A is a front isometric view of a locking wedge for the system for securing a barrel to a receiver in a rifle of FIG. 1.
Figure 9B:
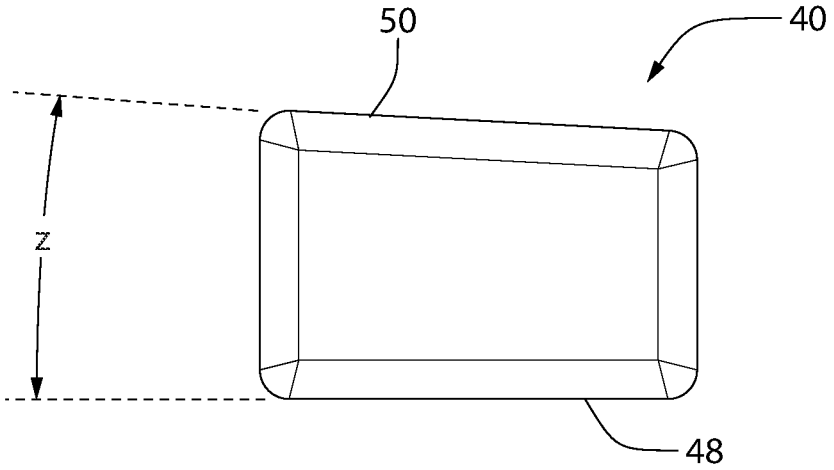
FIG. 9B is top, plan view of the locking wedge of FIG. 9A.

A locking wedge 40 is disposed in an aperture 42 in the receiver 20 by a threaded fastener 44. See FIGS. 9A and 9B. The locking wedge 40 has a central aperture 46, a first side 48 parallel to the central aperture 46, and a cam side 50 opposite the first side 48 and disposed at a small angle Z relative to the first side 48. The locking wedge 40 is movable in a direction perpendicular to the barrel axis X along axis Y.

Tightening the threaded fastener 44, e.g., by turning it clockwise, into the receiver 20 causes the cam side 50 of the locking wedge 40 to urge the protuberance 32 of the barrel extension 22 along the barrel axis X in a direction away from the muzzle end 16 of the barrel 14 and into the receiver 20. Loosening the threaded fastener 44, e.g., by turning it counterclockise, causes the cam side 50 of the locking wedge 40 to free the barrel extension 22, allowing it to move along the barrel axis X in a direction toward the muzzle end 16 of the barrel 14. Tightening the threaded fastener 44 urges the barrel extension 22 into the receiver 20, seating and aligning the barrel 14 within the receiver 20.

The barrel extension 22 may be have a taper 52 at its receiver end 26 to mate with a corresponding tapered aperture 54 in the receiver 20. Preferably, the receiver 20 fully covers the barrel extension 22 such that the barrel extension 22 is hidden within the receiver 20.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A system for securing a barrel to a receiver of a rifle, the barrel having a barrel axis, a muzzle end and a receiver end, the system comprising:

(a) a barrel extension having a barrel end and a receiver end, said barrel extension having internal threads at its barrel end for receiving external threads on the barrel and a protuberance extending from a lower side of the barrel extension;

(b) a locking wedge slidably secured in an aperture in the receiver by a threaded fastener, the locking wedge having a central aperture, a first side parallel to the central aperture, and a cam side opposite the first side and disposed at an angle relative to the first side, the locking wedge movable along an axis of the threaded fastener in a direction perpendicular to the barrel axis by rotating the threaded fastener, the cam side disposed against the protuberance;

(c) wherein tightening the threaded fastener into the receiver causes the cam side of the locking wedge to urge the protuberance of the barrel extension along the barrel axis in a direction away from the muzzle end of the barrel and into the receiver;

(d) wherein loosening the threaded fastener causes the cam side of the locking wedge to allow the barrel extension to move along the barrel axis in a direction toward the muzzle end of the barrel;

whereby tightening the threaded fastener urges the barrel extension into the receiver, seating and aligning the barrel within the receiver.

2. The system for securing a barrel to a receiver of a rifle of claim 1, wherein the barrel extension is tapered at the receiver end to mate with a corresponding tapered aperture in the receiver.

3. The system for securing a barrel to a receiver of a rifle of claim 1, including a barrel extension locking nut, said locking nut having internal threads for receiving the external threads on the barrel, said locking nut disposed adjacent the barrel end of the barrel extension.

4. The system for securing a barrel to a receiver of a rifle of claim 3, wherein the receiver fully covers the locking nut such that the locking nut is hidden within the receiver.

5. A system for securing a barrel to a receiver of a rifle, the barrel having a barrel axis, a muzzle end and a receiver end, the system comprising:

(a) a barrel extension having a barrel end and a receiver end, said barrel extension having internal threads at its barrel end for receiving external threads on the barrel and a protuberance extending from a lower side of the barrel extension, said barrel extension being tapered at the receiver end to mate with a corresponding tapered aperture in the receiver;

(b) a locking wedge slidably secured in an aperture in the receiver by a threaded fastener, the locking wedge having a central aperture, a first side parallel to the central aperture, and a cam side opposite the first side and disposed at an angle relative to an axis of the central aperture, the locking wedge movable in a direction along an axis of the threaded fastener perpendicular to the barrel axis, the cam side disposed against the protuberance;

(c) wherein tightening the threaded fastener into the receiver causes the cam side of the locking wedge to urge the protuberance of the barrel extension along the barrel axis in a direction away from the muzzle end of the barrel and into the receiver;

(d) wherein loosening the threaded fastener causes the cam side of the locking wedge to allow the barrel extension to move along the barrel axis in a direction toward the muzzle end of the barrel;

whereby tightening the threaded fastener urges the barrel extension into the receiver, seating and aligning the barrel within the receiver.

6. The system for securing a barrel to a receiver of a rifle of claim 1, including a barrel extension locking nut, said locking nut having internal threads for receiving the external threads on the barrel, said locking nut disposed adjacent the barrel end of the barrel extension, and wherein the receiver fully covers the locking nut such that the locking nut is hidden within the receiver.

* * * * *